US005287144A

United States Patent [19]

Takeda

[11] Patent Number: 5,287,144

[45] Date of Patent: Feb. 15, 1994

[54] IMAGE FORMING APPARATUS HAVING TRANSFER CHARGER WHICH IS CONTROLLED ACCORDING TO AMBIENT CONDITIONS

[75] Inventor: Atsushi Takeda, Tokyo, Japan

[73] Assignee: Canon Kabushiki Kaisha, Tokyo, Japan

[21] Appl. No.: 48,057

[22] Filed: Apr. 19, 1993

Related U.S. Application Data

[63] Continuation of Ser. No. 548,239, Jul. 5, 1990, abandoned.

[30] Foreign Application Priority Data

Jul. 5, 1989 [JP] Japan ..... 1-173407

[51] Int. Cl.[5] ..... G03G 21/00

[52] U.S. Cl. ..... 355/208; 355/272; 355/274; 355/327

[58] Field of Search ..... 355/208, 271, 272, 273, 355/274, 275, 277, 326, 327

[56] References Cited

U.S. PATENT DOCUMENTS

| | | | |
|---|---|---|---|
| 3,729,311 | 4/1973 | Langdon | 355/274 X |
| 3,781,105 | 12/1973 | Meagher | 355/274 |
| 3,837,741 | 9/1974 | Spencer | 355/274 |
| 3,877,416 | 4/1975 | Donohue et al. | 355/273 X |
| 4,134,147 | 1/1979 | Watanabe | 355/272 X |
| 4,819,025 | 4/1989 | Takahashi et al. | 355/208 X |
| 4,912,515 | 3/1990 | Amemiya et al. | 355/274 |
| 4,924,273 | 5/1990 | Joseph | 355/312 |
| 4,935,776 | 6/1990 | Fukui | 355/274 X |
| 5,019,871 | 5/1991 | Takeda et al. | 355/309 |

FOREIGN PATENT DOCUMENTS

| | | | |
|---|---|---|---|
| 55-32079 | 3/1980 | Japan . | |
| 110279 | 8/1980 | Japan | 355/274 |
| 61-150354 | 9/1986 | Japan . | |

*Primary Examiner*—A. T. Grimley
*Assistant Examiner*—Robert Beatty
*Attorney, Agent, or Firm*—Fitzpatrick, Cella, Harper & Scinto

[57] ABSTRACT

The resistivities of a transfer material or a transfer material carrying sheet change depending on the variation in the ambient conditions, the materials of the transfer material and the charge-up of the transfer material carrying sheet. Therefore, even if the charging by the transfer charger is maintained constant, the image transfer operation is not stable. An image transfer apparatus in which the charging amount by the transfer charger is controlled in accordance with the resistivities to stabilize the image transfer operation is disclosed The transfer charger will be controlled in accordance with an electric current flowing through a contact member when a transfer material passes between the contact member and a transfer material carrying sheet.

51 Claims, 8 Drawing Sheets

IMAGE FORMING APPARATUS HAVING TRANSFER CHARGER WHICH IS CONTROLLED ACCORDING TO AMBIENT CONDITIONS

This application is a continuation of application Ser. No. 07/548,239 filed Jul. 5, 1990, now abandoned.

FIELD OF THE INVENTION AND RELATED ART

The present invention relates to an image forming apparatus such as an electrophotographic copying machine or the like, more particularly to an image transfer apparatus particularly for a color image forming apparatus.

A superposing image transfer system is used to copy an image of plural colors. The system uses an image transfer drum comprising a frame in the form of a cylinder and a high resistance film (transfer material carrying sheet).

Referring first to FIG. 14, there is shown an example of such a system. The transfer material is gripped by a gripper 151 disposed at a part of a periphery of the transfer drum 150. An example of such a transfer drum having the gripper is disclosed in Japanese Laid-Open Patent Application No. 150354/1986.

Another system which does not use the gripper is known as disclosed in Japanese Laid-Open Patent Application No. 32079/1980, for example, wherein means is provided to apply electric charge to the transfer material carrying sheet and to the transfer material to electrostatically attract the transfer material on the transfer material carrying sheet.

FIG. 15 shows an example of such a transfer device in an image forming apparatus. It is possible that the electrostatic attracting means is employed in the gripper type transfer device.

In FIG. 15, a transfer apparatus 30 comprises an attraction charger 51 which applies charge to the inside of the transfer material carrying sheet 34 and a conductive roller 52 contacted to the opposite side of the transfer material carrying sheet to apply to the transfer material P the electric charge of the polarity opposite to that of the attraction charger 51. The conductive roller 52 is grounded and is used as an opposite electrode for the attraction charger 51. The transfer material P is electrostatically attracted on the transfer material carrying sheet 34 and is carried to the image transfer position, where the toner image is transferred from the photosensitive drum 1 to the transfer sheet P.

In order to obtain a color image, the above-image transfer step is repeated on the same sheet. Before the transfer material P is separated from the transfer material carrying sheet 34, a pair of dischargers 16 is used to remove the electric discharge (AC discharge) thus neutralizing the electric charge to weaken the electrostatic attraction force. Then, a raising member 53 disposed on a part of the transfer drum frame for separating the leading edge of the transfer material from the transfer material carrying sheet 34, is operated to wedge into between the transfer material P and the transfer material carrying sheet 34, so that the transfer material is separated from the sheet 34. The transfer material is conveyed to an image fixing apparatus 18, where the image is fixed. Then, the sheet is discharged.

This system involves a problem that the transfer material carrying sheet is electrically charged up by the change in the ambient conditions, depending on the material of the transfer sheet, by the superposing image transfers onto the same transfer sheet or by another cause. If this occurs, the image transfer efficiency changes, and the image quality is degraded.

SUMMARY OF THE INVENTION

Accordingly, it is a principal object of the present invention to provide an image forming apparatus wherein the deterioration of the image due to the change in the image transfer efficiency is prevented.

It is another object of the present invention to provide an image forming apparatus capable of high quality superposed images with color toner particles.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
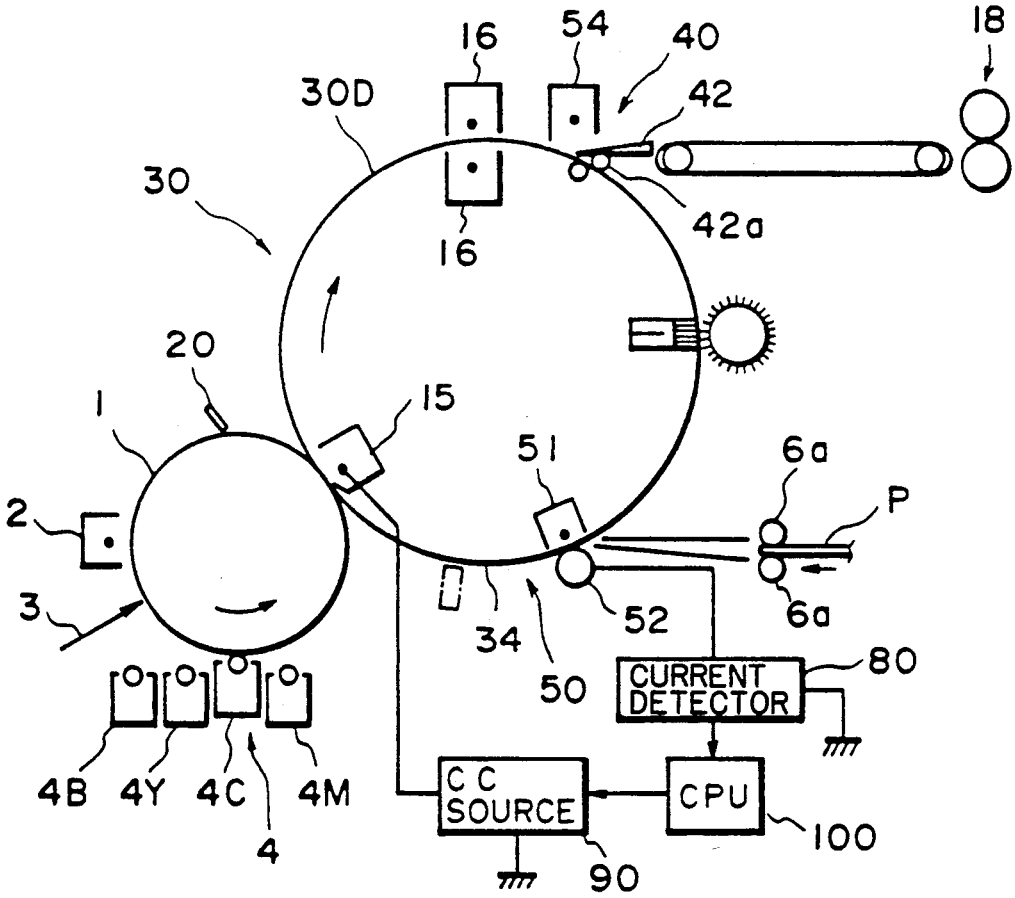
FIG. 1 is a sectional view of an image forming apparatus according to an embodiment of the present invention.

Referring now to FIG. 1, there is shown a color electrophotogrpahic apparatus as an exemplary image forming apparatus according to an embodiment of the present invention. In this embodiment, the image forming apparatus comprises an image bearing member in the form of an electrophotographic photosensitive drum 1 rotatably supported for rotation in a direction of an arrow. The photosensitive drum 1 is uniformly charged by a primary charger 2 and is exposed to light image 3 in accordance with image information by exposure means comprising a laser beam exposure apparatus, for example, so that an electrostatic latent image is formed on the photosensitive drum 1. The electrostatic latent image is visualized into a toner image on the photosensitive drum 1 by a movable type developing apparatus 4, for example. The movable type developing apparatus 4 contains developing devices 4M, 4C, 4Y and 4B for containing magenta developer, cyan developer, yellow developer and black developer, respectively. It further comprises a guide (not shown) for supporting and horizontally moving the four developing devices. The movable type developing apparatus 4 functions to present a desired one of the developing devices to a developing position where the developing device is faced to the outer periphery of the photosensitive drum 1, by which the electrostatic latent image is developed on the photosensitive drum 1.

The visualized image, that is, the toner image on the photosensitive drum 1 is transferred onto a transfer material P. The transfer material P is conveyed in the direction indicated by an arrow to be contacted to the photosensitive drum 1 at an image transfer station where the transfer drum is contacted to the photosensitive drum or faced thereto. The transfer material P is supplied to the transfer apparatus 30 in synchronism with the image by the registration rollers 6*a*.

The surface of the photosensitive drum 1 is cleaned by a cleaner 20 by which a residual toner is removed from the photosensitive drum 1, and the transfer drum 1 is prepared for the next color image forming process.

Figure 2:
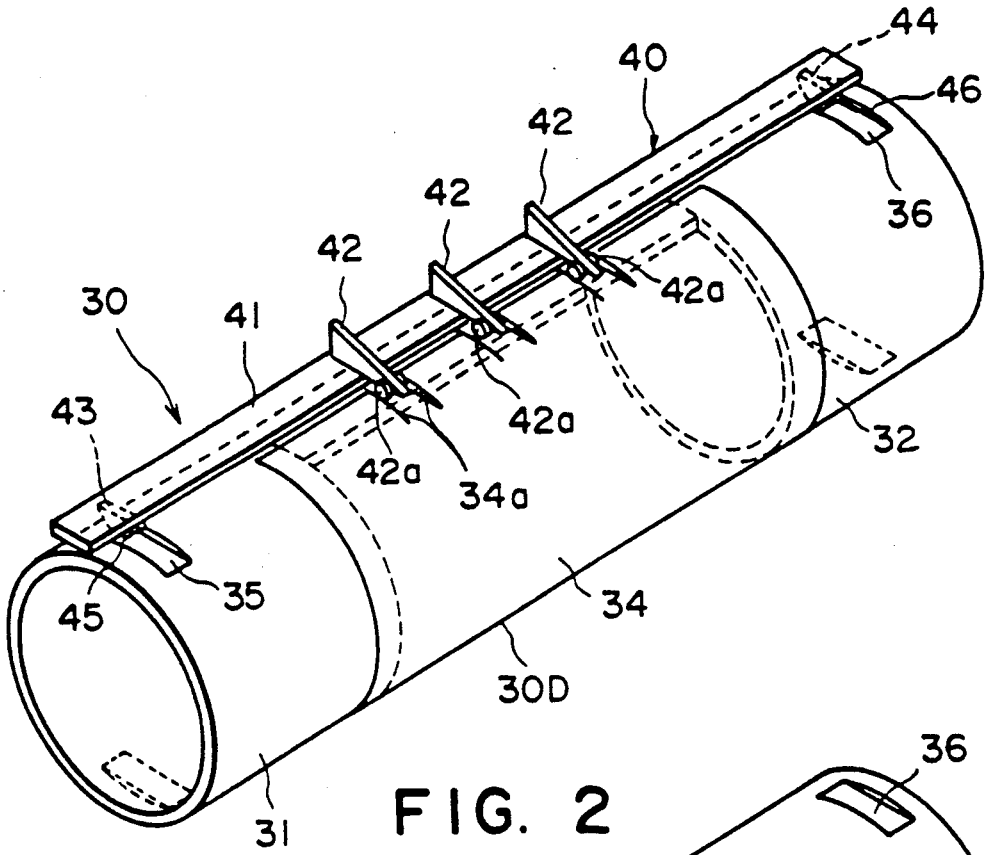
FIG. 2 is a perspective view illustrating the major part of the transfer apparatus used in the image forming apparatus of FIG. 1.
Figure 3:
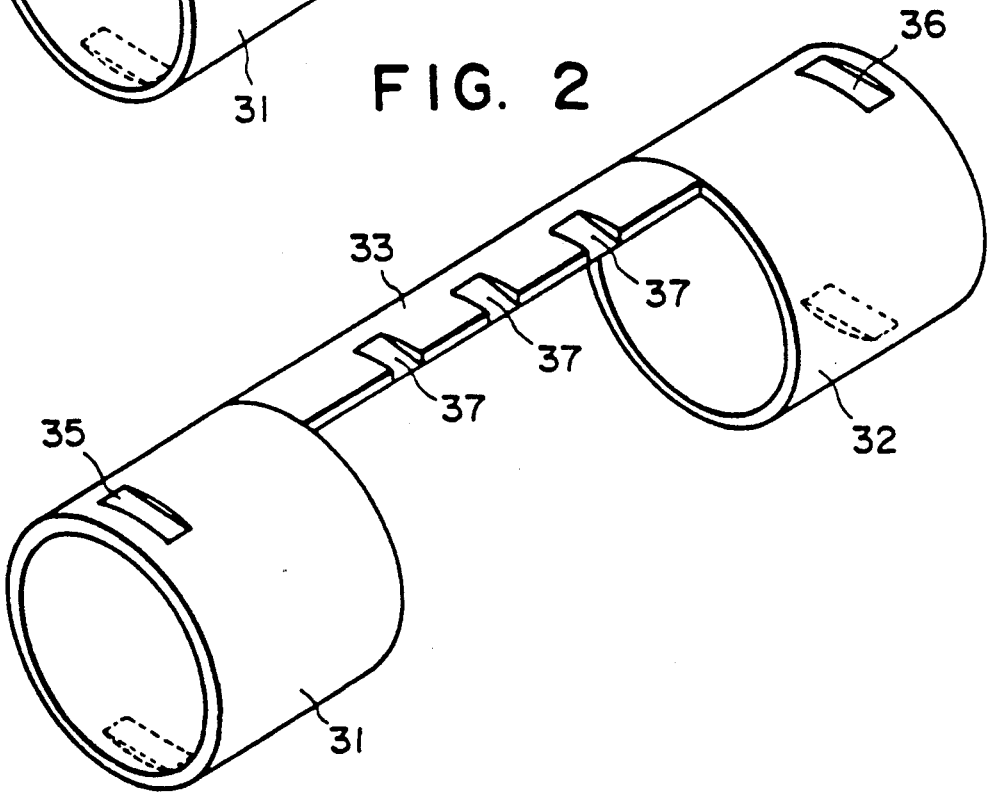
FIG. 3 is a perspective view of a guiding frame of the image transfer apparatus of FIG. 2.

Referring to FIGS. 2 and 3, an example of the image transfer apparatus 30 used with the color electrophotographic apparatus in this embodiment. The transfer apparatus 30 comprises opposite columnar rings 31 and 32 and a connector 33 for connecting the rings 31 and 32. The rings 31 and 32 and the connector 33 constitute a frame of a transfer drum for supporting the transfer material carrying member in the form of the transfer material carrying sheet 34. The transfer apparatus 30 further comprises separating means 40. The separating means 40 comprises a separation pawl supporting member 41 extending along an axial direction of the transfer drum 30D, a plurality of separating members, three separating pawls 42 fixed on the supporting member 41. An end of the separation pawl 42 is provided integrally with a separation outer roller 42*a* for the purpose which will be described hereinafter.

Figure 4:
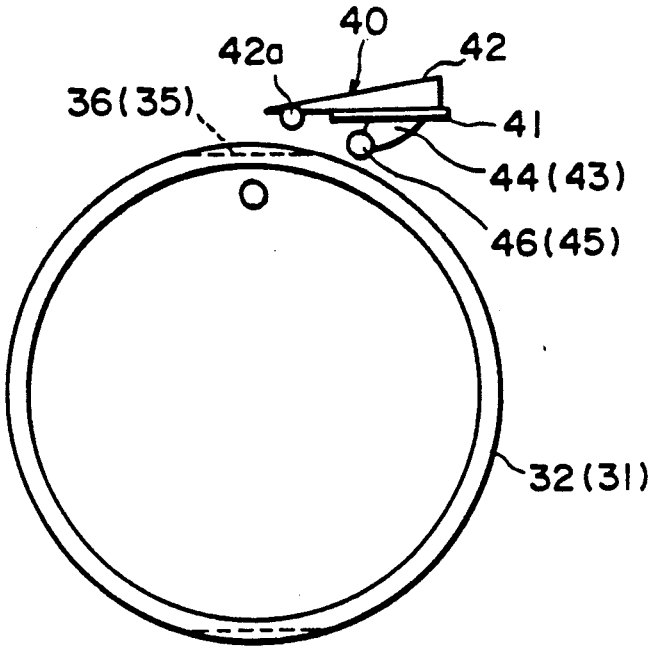
FIG. 4 is a side view of the image transfer apparatus of FIG. 2.

As will be understood from FIGS. 2 and 4, the opposite ends of the supporting member 41 are provided with abutting rollers 45 and 46 through suitable supporting plates 43 and 44. The abutting rollers 45 and 46 are brought into contact with the columnar rings 31 and 32 of the transfer drum 30D when a clutch for driving the separating pawl is actuated. In addition, the abutting rollers 45 and 46 are guided along guiding grooves 35 and 36 formed in the rings 31 and 32, by which the end of the separating pawl 42 is rotated downwardly, that is, in the direction perpendicular to the transfer drum 30D.

Figure 5:
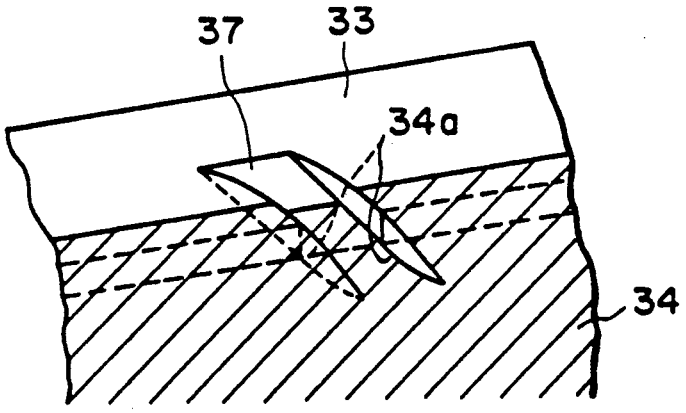
FIG. 5 is a perspective view of the sheet at the position of the connector of the guiding frame of the transfer material carrying sheet in the transfer apparatus of FIG. 2.

The connector 33 is provided with a cut-away portion 37 to facilitate the separating pawl 42 to wedge into between the transfer material carrying sheet 34 and the transfer material P thereon. The leading edge of the transfer material carrying sheet 34, as shown in FIGS. 2 and 5, has a cut 34*a* along the cutaway portion 37 of the connector 33 up to the non-image area of the transfer material, by which the curvature of the transfer material carrying sheet 34 (hatched portion in FIG. 5) is locally large at the cut-away portion, where the transfer material carrying sheet 34 is fixed to the connector 33.

The transfer apparatus 30 includes a transfer material attraction means 50 for attracting the transfer material P supplied to the transfer apparatus 30 on the transfer material carrying sheet 34. The attracting means 50, as shown in FIG. 1, is disposed inside the transfer drum 30D, and comprises an attracting corona charger for 51 for applying to the backside of the transfer material carrying sheet 34 the electric charge having a polarity opposite to that of the toner image, that is, the same as the charge by the transfer charger, and a conductive roller 52 disposed outside the transfer drum 30D. The conductive roller 52 is grounded through a current detecting means 80, and therefore, it functions as an opposite electrode for the attraction corona charger 51. In addition, it also functions to apply to the transfer material the electric charge having the polarity opposite to that of the voltage applied to the attraction corona charger, so that the transfer material P is electrostatically attracted on the transfer material carrying sheet 34.

The transfer material P attracted by the transfer apparatus 30 is conveyed to an image transfer region where the transfer charger 15 is disposed. To the backside of the transfer material carrying sheet 34, the electric charge having the polarity opposite to that of the toner is applied by the transfer corona charger 15 so as to transfer the first color toner image, for example, a magenta toner image on the photosensitive drum 1 is transferred onto the transfer material. Subsequently, the same latent image is formed on the photosensitive drum 1 and is developed with the first color toner, and thereafter, it is transferred onto the second transfer material. By the time when the first transfer material comes to the position of the conductive roller 52 the second time, the conductive roller 52 is moved away from the transfer material carrying sheet 34 by not less than 2 mm so that the toner image transferred onto the transfer material P is not disturbed.

A toner image for the second color is formed on the photosensitive drum 1 in synchronism with the transfer material having the first color transferred image is transferred onto the first transfer material P by the transfer corona charger 15. Subsequently, the second color toner image is transferred also onto the first transfer material having the first color toner image. In the similar manner, four color toner images are transferred onto the transfer material P, respectively.

The description will be made as to means for detecting state of attraction of the transfer material on the transfer material carrying sheet.

The state of attraction of the transfer material is dependent upon the ambient condition, the material of the transfer sheet and the toner images superposedly transferred thereon. For example, when the humidity is high, the resistivities of the transfer material and the transfer material carrying sheet are low, so that the attraction force between the transfer material and the carrying sheet is weak. The amounts of the electric charge on the transfer material and the transfer material carrying sheet are smaller than when the humidity is low, and therefore, the image transfer is not sufficient if the charging performance (quantity) of the transfer charger 15 is maintained constant.

In order to change the charge amount by the transfer charger 15 in accordance with the state of attraction of the transfer material, the conductive roller 52 is grounded through current detecting means 80. The attraction corona charger 51 has the same charging polarity as the transfer charger 15 produces the constant discharge, so that the backside of the transfer material carrying sheet 34 is charged to a constant level. The same amount of electric charge in the polarity opposite to that of the electric charge on the carrying sheet 34 from the attraction corona charger 51 is induced in the conductive roller 52 to charge the transfer material. This produces an induced current. The induced current changes depending on the state of attraction of the transfer material. The current is detected by the current detecting means 80, and the output thereof is supplied to a CPU 100 which is responsive to the output to control the transfer charger 15 through a constant current source 90. In this manner, the transfer charger 15 is controlled in accordance with the state of attraction of the transfer material.

According to the present invention, the transfer current is determined, and the determined transfer current is supplied to the transfer charger 15, in the following manner.

Figure 6:
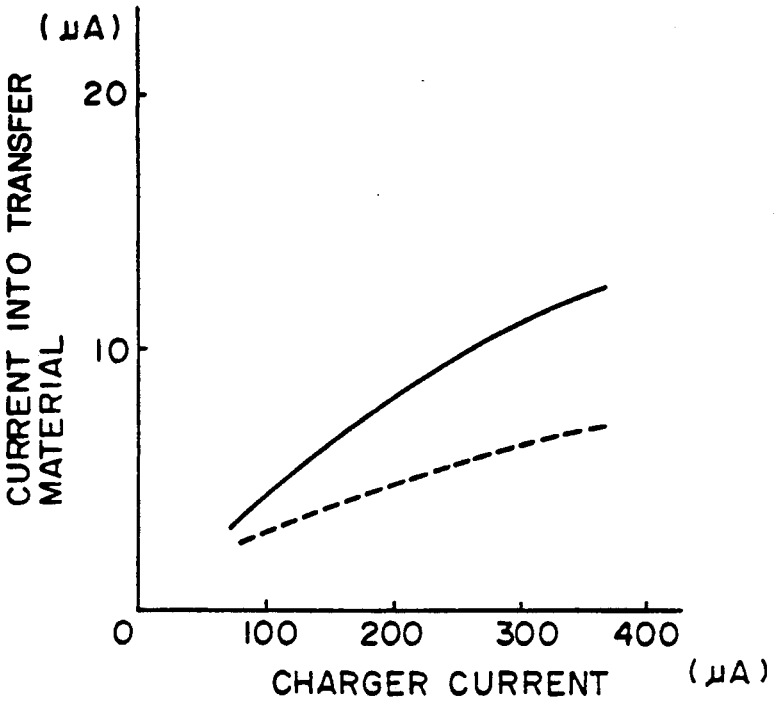
FIG. 6 is a graph showing an example of a relation between an attraction charge current and a current into the transfer material, in the image transfer apparatus of FIG. 2.

The example of the determination of the transfer current will be described. FIG. 6 shows a relation between the current (attraction charging current) through the attraction corona charger 51 and the induced current flowing into the transfer material from the conductive roller 52 for each of a plain paper and OHP (overhead projector sheet). The solid line and the broken line represent the plain paper case and the OHP sheet case. It will be understood that when the attraction charging current is constant, the induced current changes depending on the materials of the transfer sheet.

Figure 7:
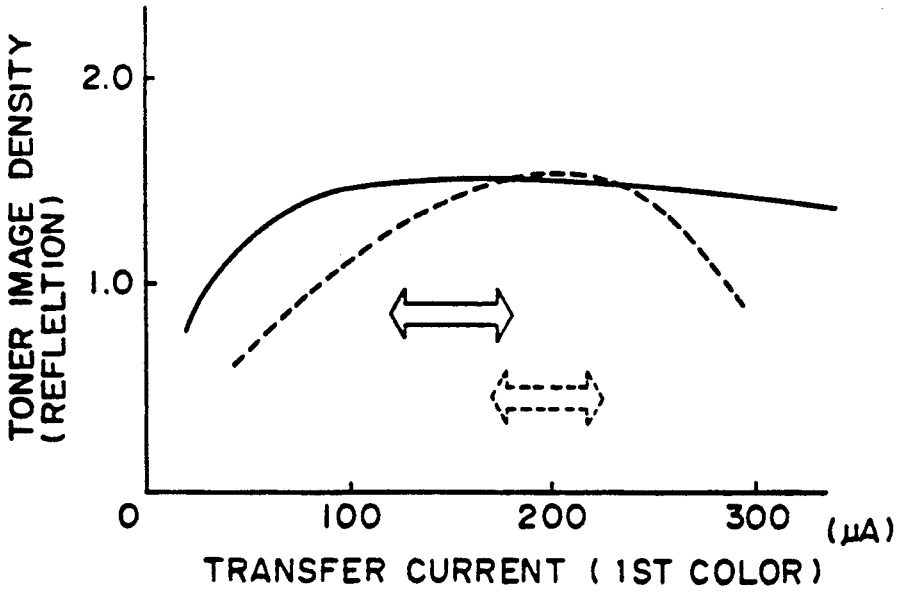
FIG. 7 is a graph showing a relation between an image transfer current and the image density of the transferred toner image in the image transfer apparatus of FIG. 2.

FIG. 7 is a graph showing a relation between a transfer current and an image density (reflection density) of the toner image transferred onto the transfer material P when the toner images produced by the same amount of the toner photosensitive drum 1. It will be understood that depending on the material of the transfer sheet, the high image density region, that is, the high image transfer efficiency region (proper transfer current region indicated by the double head arrow in FIG. 7) is different. The solid line represents the case of plain paper, and the broken line, the case of OHP sheet.

Therefore, when the attraction charging current is 200 micro-amperes, the induced current is detected by the current detecting means 80 and is supplied to the CPU 100. The CPU 100 changes the transfer current through the constant current source 90 with the boundary of the induced current of 6.5 microamperes, as shown in Table 1, for example.

TABLE 1

| | Induced Current ≧6.5 μA | Induced Current ≦6.5 μA |
|---|---|---|
| 1st Color Transfer Current (μA) | 150 | 200 |
| 2nd Color Transfer Current (μA) | 180 | 250 |
| 3rd Color Transfer Current (μA) | 210 | 330 |
| 4th Color Transfer Current (μA) | 240 | 450 |

Referring back to FIG. 1, the transfer apparatus 30 is provided with a pair of AC corona discharger 16 sandwiching the transfer material carrying sheet 34 in order to weaken the attraction force between the transfer material and the transfer material carrying sheet after the completion of the image transfer step. By the AC corona discharger 16, the transfer material P and the transfer material carrying sheet 34 are electrically discharged.

When the image transfer operation is completed in the described manner, the abutting rollers 45 and 46 of the separating means 40 is actuated by a separating pawl actuating clutch (not shown), as will be understood from FIGS. 1 and 4 in order to separate the first transfer material P from the transfer material carrying sheet 34. The rollers 45 and 46 are abutted to the rings 31 and 32 of the transfer drum 30D, and are guided along the guiding grooves 35 and 36 formed in the rings 31 and 32. Then, the free end portions of the separating pawl 42 are rotated downwardly, that is, toward the transfer material carrying sheet 34 in a detection perpendicular to the transfer drum 30D, by which an outside separation roller **42*a* integrally following the separation pawl 42 is abutted to the transfer material carrying sheet 34. The outside separation roller 42*a* moves along the cutaway portion 37 of the connector 33. At the position where the curvature of the transfer material carrying sheet 34 is locally changed, the separation pawl 42 is wedged into between the leading edge of the transfer material and the transfer material carrying sheet 34, so that the transfer material P is separated from the transfer material carrying sheet 34**.

When the transfer material P is to be separated, it is preferable that the AC corona discharge is effected by the corona discharger 54 in order to prevent the disturbance of the image by a separation discharge which occurs when the transfer material P is separated from the transfer material carrying sheet 34.

After the completion of the image transfer, and the transfer material separation, the transfer material is conveyed to the image fixing apparatus 18, where the toner images are fixed by heat. Then, the sheet is discharged so that the image forming operation is completed.

Figure 8:
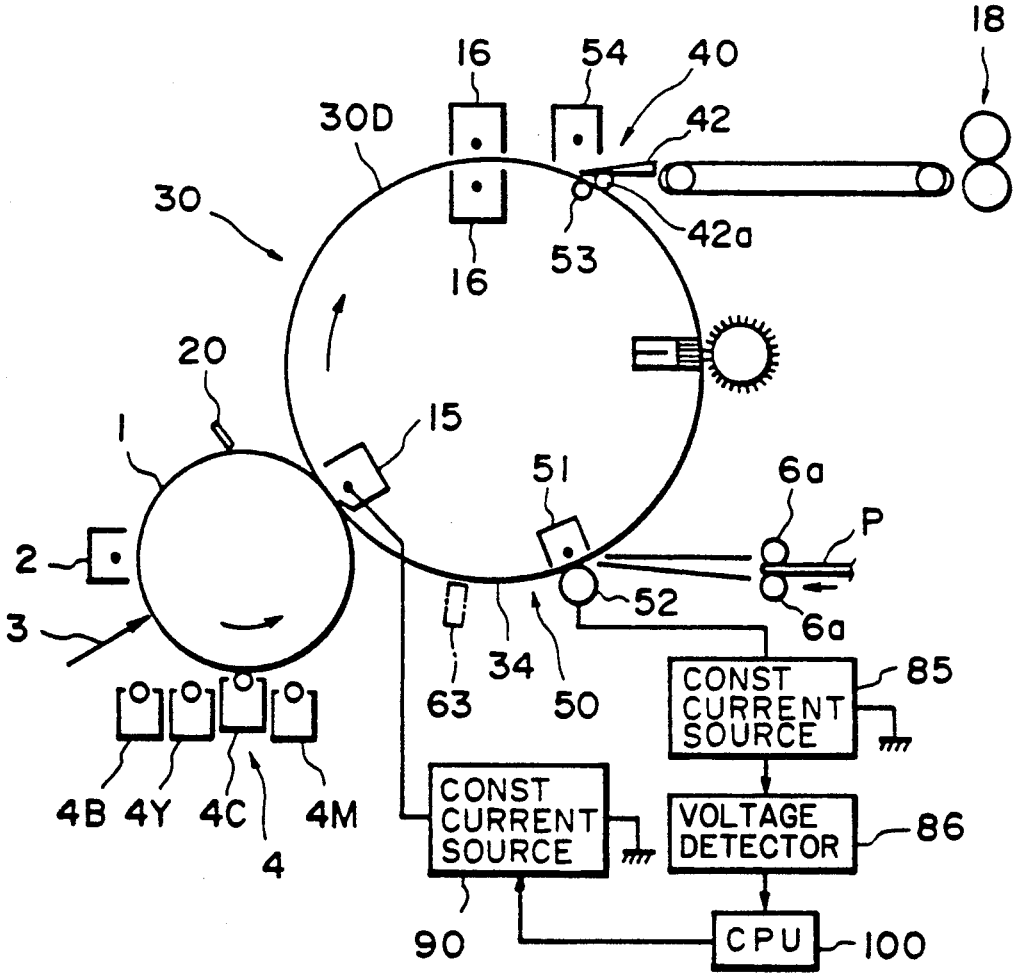
FIG. 8 is a sectional view of an image forming apparatus according to another embodiment of the present invention.

Referring to FIG. 8, there is shown an image forming apparatus according to a second embodiment. In this embodiment, a constant DC current source 85 and the voltage detecting means 86 are disposed between the conductive roller 52 and the ground of the transfer apparatus 30. In FIG. 8, the same reference numerals as in FIG. 1 are assigned to the elements having the corresponding functions, and therefore, the detailed description of such elements are omitted for simplicity.

In this embodiment, by means of the DC constant current source 85, a constant current flows through the conductive roller 52. Since a different voltage is produced between the attraction corona charger 51 and the conductive roller 52, depending on the state of attraction between the transfer material and the transfer material carrying sheet 34 (the resistivity or resistivities of the transfer material and/or the transfer material carrying sheet), the voltage is detected by the voltage detecting means 86. The transfer charger 15 is controlled using the CPU 100 and the constant current source 90.

Figure 9:
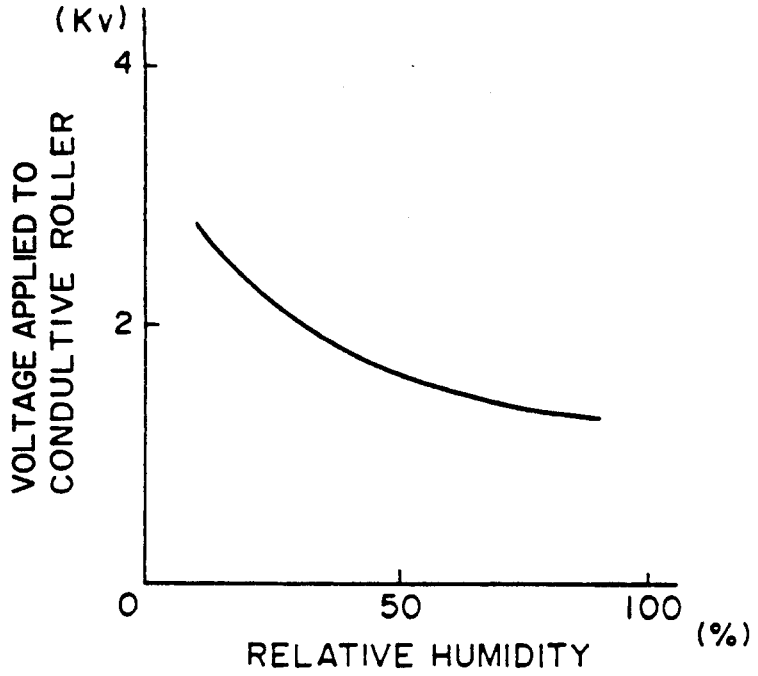
FIG. 9 is a graph showing a relation between a relative humidity and a voltage applied to the attraction conductive roller under constant attraction current in the image transfer apparatus of the image forming apparatus of FIG. 8.

FIG. 9 shows a relation between the ambient condition (relative humidity) change and the voltage detected by the voltage detecting means 86, when the current (attraction charging current) by the attraction corona charger is 200 micro-amperes, and the current flowing into the transfer material P by the conductive roller 52 is 10 micro-amperes. It will be understood that the induced current decreased with the decrease of the relative humidity.

Figure 10:
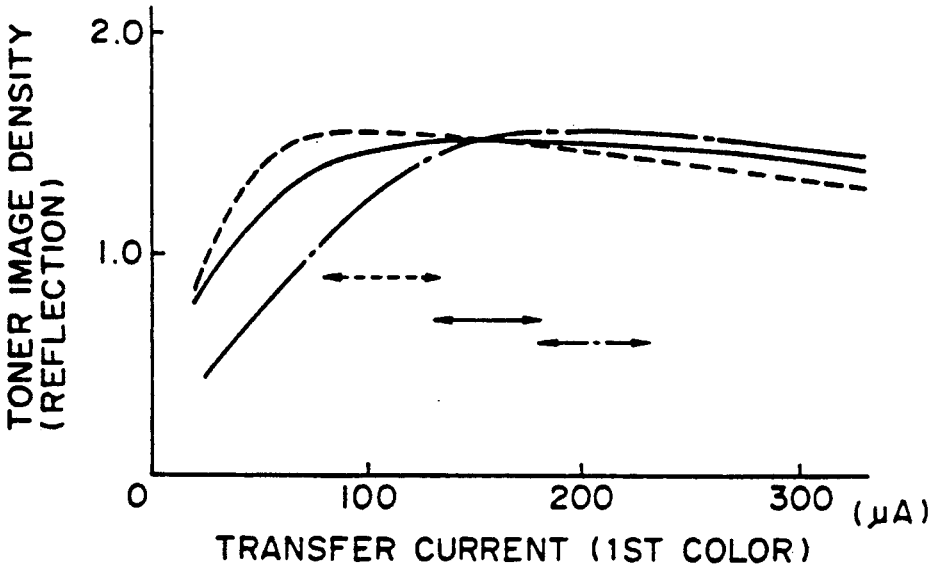
FIG. 10 is a graph showing a relation between an image transfer current and an image density of the transferred toner image in the image transfer apparatus in the image forming apparatus of FIG. 8.

FIG. 10 shows the transfer current and the toner image density (refraction density) of the toner image transferred onto the transfer material when the toner images are formed on the photosensitive drum 1 with the same amount of toner, when the relative humidity is 15% (chain line), 50% (solid line) and 80% (broken line). It will be understood that the proper range of the transfer current changes in accordance with the relative humidity. The proper range for the 80%, 50% and 15% of the relative humidity are indicated by double head arrows of broken line, solid line and chain line, respectively.

In accordance with the detection by the voltage detecting means 86, the transfer current to the transfer charger 15 is changed by the CPU 100 through the transfer constant current source 90 for 1.4 KV (A region), for not less than 1.4 KV and less than 2.0 KV (B region) and for not less than 2.0 KV (C region) as shown in Table 2, for example.

TABLE 2

| | A region (<1.4 KV) | B Region (1.4–2.0 KV) | C Region (≧2.0 KV) |
|---|---|---|---|
| 1st Color Transfer Current (μA) | 100 | 150 | 200 |
| 2nd Color Transfer Current (μA) | 100 | 180 | 250 |
| 3rd Color Transfer Current (μA) | 100 | 210 | 300 |
| 4th Color Transfer Current (μA) | 100 | 240 | 350 |

A third embodiment will be described in the case of a continuous copying operation (superposing image transfer operation).

This embodiment can be carried out with the structure of the second embodiment. Here, the description will be made as to the structure of the embodiment 1, wherein the current detecting means 80 is disposed between the conductive roller 52 and the ground.

During the continuous copying operation, the transfer material carrying sheet 34 (FIG. 2) is charged up if the discharging power of the pair of discharging corona discharger 16 is low. This tendency is remarkable under the low humidity conditions.

Figure 11:
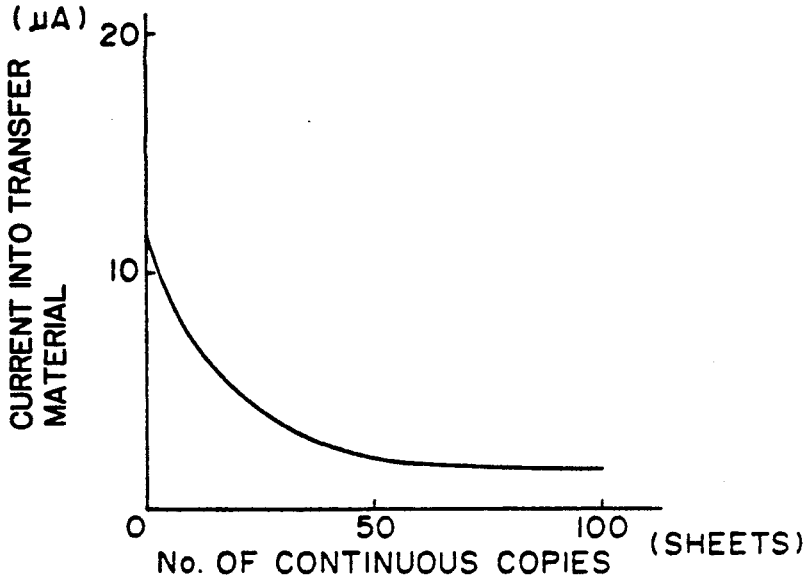
FIG. 11 is a graph showing a relation between number of copies produced in a continuous copying mode and the current into the transfer material in an image transfer apparatus used in an image forming apparatus according to a further embodiment of the present invention.

FIG. 11 shows the relation between the number of copies continuously produced and the induced current measured by the current detecting means 80 when the relative humidity is 15%; the inside discharger 16 disposed faced to the inside of the transfer material carrying sheet 34 is supplied with a DC biased AC voltage having a peak-to-peak voltage Vpp of 12.0 KV and a DC component difference of −100 micro-amperes; and the outside discharger 16 disposed faced to the outside of the transfer material carrying sheet 34 is supplied with an AC voltage having the peak-to-peak voltage Vpp=10.0 KV and a phase different by $\pi$ from that of the inside discharger 16.

Figure 12:
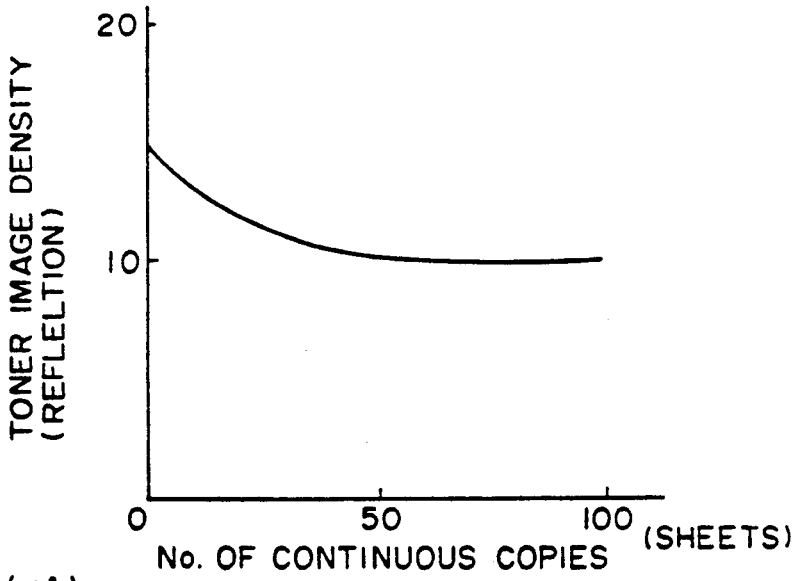
FIG. 12 is a graph showing a relation between the number of copies produced during the continuous mode and the image density of the transferred toner image in the same apparatus.

FIG. 12 shows the image density change under a constant current (150 micro-amperes, for example) when the toner images are formed on the photosensitive member with the same amount of the toner.

It will be understood that the induced current, that is, the current flowing to the transfer material for the attraction changes to decrease the image density in accordance with the increase of the number of copies continuously produced.

Figure 13:
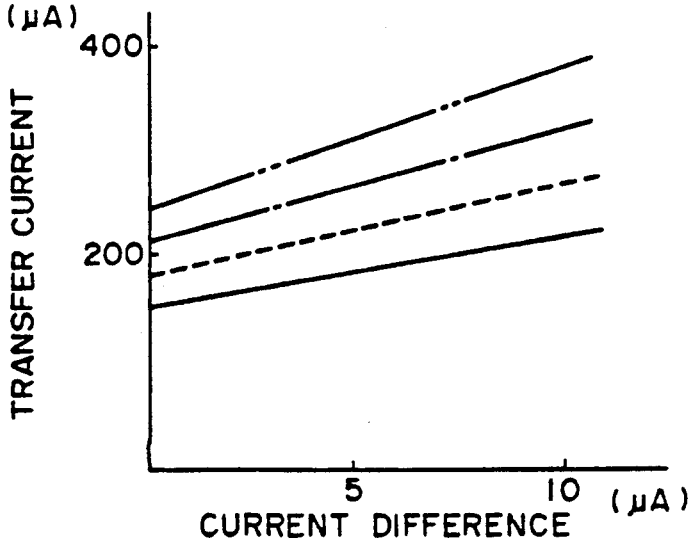
FIG. 13 is a graph showing a relation between the current into the transfer material during the continuous copying mode and the transfer current in the image transfer apparatus.
Figure 14:
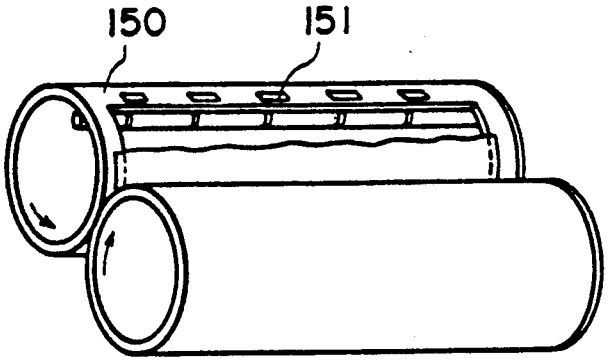
FIG. 14 PRIOR ART
FIG. 14 is a perspective view of an image transfer material in an image transfer apparatus used in a conventional image forming apparatus.
Figure 15:
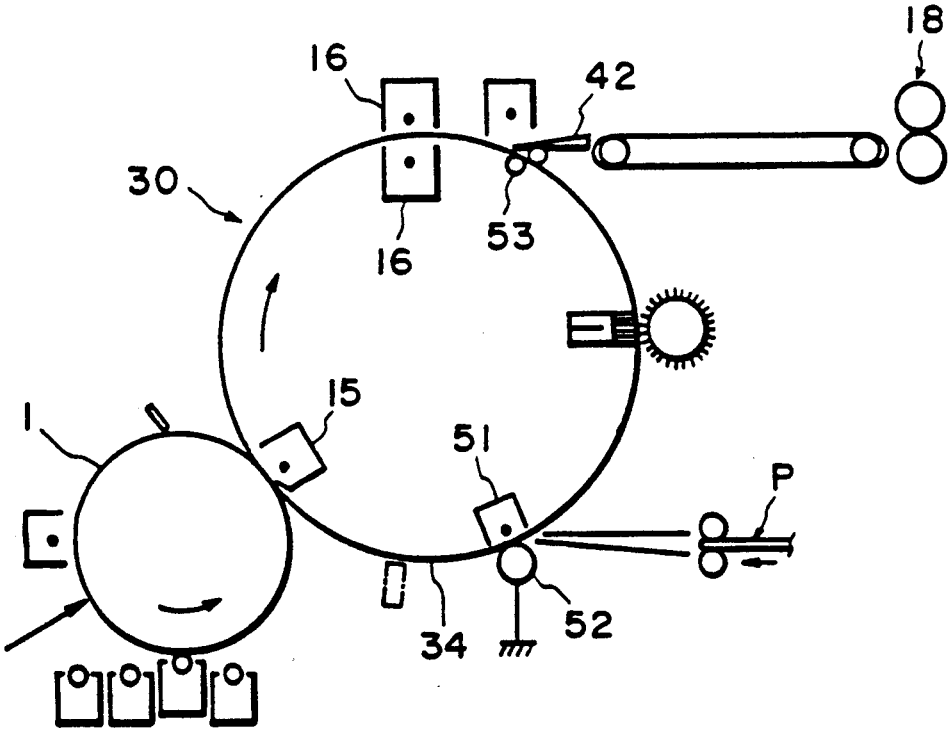
FIG. 15 PRIOR ART
FIG. 15 shows another conventional image forming apparatus.

As shown in FIG. 13, for example, the transfer current is changed during the continuous copying operation in accordance with the difference of the induced current detected and the current detected for the first sheet. Here, the solid line represents the transfer current; the broken line represents the transfer current in the second color; the chain line represents the transfer current in the third color; and the chain line with two dots represent the transfer current in the fourth color.

Thereafter, the transfer material separating step and the image fixing step are completed. The copying operation is completed after the input number of copies are produced.

As described in the foregoing, according to the present invention, the detecting means is provided to detect the amount of electric charge applied by the charge application means to the transfer material, and the change in the transfer efficiency due to the material of the transfer sheet and the change of the ambient condition or the proceeding of the continuous copying operations can be compensated in accordance with the detected amount of electric charge, by changing the transfer current of the image transfer means. Therefore, the change of the transfer efficiency can be prevented to stable provide a high quality image.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

an image bearing member;

means for forming a toner image on said image bearing member;

transfer material carrying means for carrying a transfer material to an image transfer position to receive the toner image from said image bearing member, said transfer material carrying means including a transfer material carrying member for carrying the transfer material;

contacting member contactable to said transfer material carrying member at a side of said member that is contactable to the transfer material;

discharging means for applying electric charge to the transfer material carried on the transfer material carrying means; and control means for controlling an output of said discharging means in accordance with an electric current which flows through said contacting member when the transfer material passes between said transfer material carrying member and said contacting member.

2. An apparatus according to claim 1, wherein said contacting member is electrically grounded.

3. An apparatus according to claim 2, further comprising second discharging means for applying electric charge on said transfer material carrying member, said second discharging means being disposed on an opposite side of said transfer material carrying member from said contacting member, said second discharging means effecting a discharging operation when the transfer material passes between said carrying member and said contacting member.

4. An apparatus according to claim 1, wherein said discharging means is disposed on an opposite side of said carrying member from said image bearing member and is effective to transfer the toner image from said image bearing member to the transfer material carried on said carrying member.

5. An apparatus according to claim 1, wherein said toner image forming means includes means for transferring different color toner images superimposedly from said image bearing member onto the same transfer material carried on said carrying member.

6. An apparatus according to claim 5, wherein said apparatus is capable of forming a full-color toner image.

7. An apparatus according to claim 1 or 3, wherein when the transfer material passes between said carrying member and said contacting member, the transfer material is electrostatically attracted onto said carrying member.

8. An apparatus according to claim 1, wherein said contacting member is in the form of roller.

9. An apparatus according to claim 7, wherein said carrying member is in the form of a dielectric sheet.

10. An image forming apparatus, comprising:

an image bearing member;

means for forming a toner image on said image bearing member;

transfer material carrying means for carrying a transfer material to an image transfer position to receive the toner image from said image bearing member, said transfer material carrying means including a transfer material carrying member for carrying the transfer material;

a contacting member contactable to said transfer material carrying member at a side of said member that is contactable to the transfer material;

discharging means for applying electric charge to the transfer material carried on the transfer material carrying member;

constant current control means for maintaining a constant current supply to said contacting member as the transfer material passes between said carrying member and said contacting member; and second control means for controlling an output of said discharging means in accordance with a voltage during constant current control by said constant current control means.

11. An apparatus according to claim 10, wherein said contacting member is electrically grounded.

12. An apparatus according to claim 10, further comprising second discharging means for applying electric charge on said transfer material carrying member, said second discharging means being disposed sandwiching said transfer material carrying member with said contacting member, said second discharging means effecting a discharging operation when the transfer material passes between said carrying member and said contacting member.

13. An apparatus according to claim 10, wherein said discharging means is disposed on an opposite side of said carrying member from said image bearing member and is effective to transfer the toner image from said image bearing member to the transfer material carried on said carrying member.

14. An apparatus according to claim 10, wherein said toner image forming means includes means for transferring different color toner images superimposedly from said image baring member onto the seam transfer material carried on said carrying member.

15. An apparatus according to claim 14, wherein said apparatus is capable of forming a full-color toner image.

16. An apparatus according to claim 10 or 13, wherein when the transfer material passes between said carrying member and said contacting member, the transfer material is electrostatically attracted onto said carrying member.

17. An apparatus according to claim 10, wherein said contacting member is in the form of roller.

18. An apparatus according to claim 16, wherein said carrying member is in the form of a dielectric sheet.

19. An apparatus according to claim 10, wherein said second control means controls output of said discharging means in accordance with a voltage of said contacting member during the constant current control operation of said constant current control means.

20. An image forming apparatus, comprising:

a recording material carrying member for carrying a recording material;

image forming means for forming a toner image on the recording material carried on said recording material carrying member;

contacting member contactable to said recording material carrying member; and control means for controlling an image forming condition of said image forming means in accordance with a current through said contacting member when the recording material passes between said recording material carrying member and said contacting member.

21. An apparatus according to claim 20, wherein said image forming means includes an image bearing member and image transfer charging means for transferring the image from said image bearing member to the recording material, and said control means limits an output of said transfer charging means.

22. An apparatus according to claim 20, wherein said contacting member is electrically grounded.

23. An apparatus according to claim 20, further comprising discharging means for applying electric charge to said carrying member, said discharging means disposed such that said carrying member is between said discharging means and said contacting member, wherein when the recording material passes between said carrying member and said contacting member, said discharging means effects a discharging operation.

24. An apparatus according to claim 21, wherein said toner image forming means includes means for transferring different color toner images superimposedly from said image bearing member onto the same recording material carried on said carrying member.

25. An apparatus according to claim 24, wherein said apparatus is capable of forming a full-color toner image.

26. An apparatus according to claim 20 or 23, wherein when the recording material passes between said carrying member and said contacting member, the recording material is electrostatically attracted onto said carrying member.

27. An apparatus according to claim 20, wherein said contacting member is in the form of roller.

28. An apparatus according to claim 26, wherein said carrying member is in the form of a dielectric sheet.

29. An image forming apparatus, comprising:

a recording material carrying member for carrying a recording material;

image forming means for forming a toner image on the recording material carried on said recording material carrying member;

a contacting member contactable to said recording material carrying member;

constant current control means for maintaining constant the current supplied to said contacting member as the recording material passes between said carrying member and said contacting member; and second control means for controlling an image forming condition in accordance with a voltage during constant current control by said constant current control means.

30. An apparatus according to claim 29, wherein said image forming means includes an image bearing member and image transfer charging means for transferring the image from said image bearing member to the recording material, and said second control means limits an output of said transfer charging means.

31. An apparatus according to claim 29, wherein said second control means controls the image forming condition of said image forming means in accordance with a voltage of said contacting member during the constant current control operation of said constant current control means.

32. An apparatus according to claim 29, wherein said contacting member is electrically grounded.

33. An apparatus according to claim 29, further comprising discharging means for applying electric charge to said carrying member, said discharging means disposed such that said carrying member is between said discharging means and said contacting member, wherein when the recording material passes between said carrying member and said contacting member, said discharging means effects a discharging operation.

34. An apparatus according to claim 30, wherein said toner image forming means includes means for transferring different color toner images superimposedly from said image bearing member onto the same transfer material carried on said carrying member.

35. An apparatus according to claim 34, wherein said apparatus is capable of forming a full-color toner image.

36. An apparatus according to claim 29 or 33, wherein when the recording material passes between said carrying member and said contacting member, the recording material is electrostatically attracted onto said carrying member.

37. An apparatus according to claim 29, wherein said contacting member is in the form of roller.

38. An apparatus according to claim 36, wherein said carrying member is in the form of a dielectric sheet.

39. An image forming apparatus, comprising:

a recording material carrying member for carrying a recording material;

image forming means for forming a toner image on the recording material carried on said recording material carrying member;

attracting means for electrostatically attracting the recording material to said recording material carrying member, said attracting means having an attracting member on a recording material carrying side of said recording material carrying member; and control means for controlling an image forming condition of said image forming means in accordance with a current through said attracting means when the recording material passes between said recording material carrying member and said contacting member.

40. An apparatus according to claim 39, wherein said image forming means includes an image bearing member and image transfer charging means for transferring the image from said image bearing member to the recording material, and said control means limits an output of said transfer charging means.

41. An apparatus according to claim 39, wherein said attracting means includes discharging means for applying electric charge to said recording material carrying member, said discharging means is disposed so as to interpose said carrying member with said attracting member, and said discharging means effects a discharging operation when the recording material passes between said carrying member and said attracting member.

42. An apparatus according to claim 40, wherein said toner image forming means includes means for transferring different color toner images superimposedly from said image bearing member onto the same transfer material carried on said carrying member.

43. An apparatus according to claim 42, wherein said apparatus is capable of forming a full-color toner image.

44. An apparatus according to claim 39, wherein said carrying member is in the form of a dielectric sheet.

45. An image forming apparatus, comprising:

a recording material carrying member for carrying a recording material;

image forming means for forming a toner image on the recording material carried on said recording material carrying member;

attracting means for electrostatically attracting the recording material to said recording material carrying member, said attracting means having an attracting member on a recording material carrying side of said recording material carrying member;

constant current control means for maintaining a constant current supply to said attracting member as the recording material passes between said recording material carrying member and said attracting member; and a second control means for controlling an image forming condition of said image forming means in accordance with a voltage during constant current control by said constant current control means.

46. An apparatus according to claim 45, wherein said image forming means includes an image bearing member and image transfer charging means for transferring the image from said image bearing member to the recording material, and said second control means controls an output of said transfer charging means.

47. An apparatus according to claim 45, wherein said second control means controls the image forming condition of said image forming means in accordance with a voltage of said attracting member during the constant current control operation of said constant current control means.

48. An apparatus according to claim 45, wherein said attracting means includes discharging means for applying electric charge to said recording material carrying member, said discharging means is disposed such that said carrying member is interposed with said attracting member and said discharging means, and said discharging means effects a discharging operation when the recording material passes between said carrying member and said attracting member.

49. An apparatus according to claim 46, wherein said toner image forming means includes means for transferring different color toner images superimposedly from said image bearing member onto the same transfer material carried on said carrying member.

50. An apparatus according to claim 49, wherein said apparatus is capable of forming a full-color toner image.

51. An apparatus according to claim 45, wherein said carrying member is in the form of a dielectric sheet.

* * * * *

UNITED STATES PATENT AND TRADEMARK OFFICE

CERTIFICATE OF CORRECTION

PATENT NO. : 5,287,144
DATED : February 15, 1994
INVENTOR(S) : ATSUSHI TAKEDA

It is certified that error appears in the above-indentified patent and that said Letters Patent is hereby corrected as shown below:

Column 9,
Line 65, "sandwiching" should read --on an opposite side of--; and
Line 66, "with" should read --from--.

Column 10,
Line 12, "baring" should read --bearing--, and "seam" should read --same--.

Column 12,
Line 22, "so as to" should read --such that--;
Line 23, "interpose" should be deleted and "member" should read --member is interposed--;
Line 24, "member," should read --member and said discharging means,--; and
Line 31, "transfer" should read --recording--.

Column 14,
Line 6, "transfer" should read --recording--.

UNITED STATES PATENT AND TRADEMARK OFFICE

CERTIFICATE OF CORRECTION

PATENT NO. : 5,287,144
DATED : February 15, 1994
INVENTOR(S) : ATSUSHI TAKEDA

It is certified that error appears in the above-indentified patent and that said Letters Patent is hereby corrected as shown below:

Figure 7,
"(REFLETION)" should read --(REFLECTION)--.

Figure 12,
"(REFLETION)" should read --(REFLECTION)--.

Signed and Sealed this

Sixth Day of September, 1994

Bruce Lehman

*Attest:*

BRUCE LEHMAN

*Attesting Officer*

*Commissioner of Patents and Trademarks*